US005526567A

United States Patent [19]

Carson, III et al.

[11] Patent Number: 5,526,567

[45] Date of Patent: Jun. 18, 1996

[54] SHAVING SYSTEM

[75] Inventors: William C. Carson, III, Acton; Frederick R. Borden, Brockton, both of Mass.

[73] Assignee: The Gillette Company, Boston, Mass.

[21] Appl. No.: 422,642

[22] Filed: Apr. 14, 1995

Related U.S. Application Data

[60] Continuation of Ser. No. 142,164, Oct. 22, 1993, abandoned, which is a division of Ser. No. 958,500, Oct. 8, 1992, Pat. No. 5,331,740.

[51] Int. Cl.[6] ..... B26B 21/22

[52] U.S. Cl. ..... 30/50; 30/346.58

[58] Field of Search ..... 30/47–50, 346.58, 30/346.59

[56] References Cited

U.S. PATENT DOCUMENTS

| | | | |
|---|---|---|---|
| 3,783,510 | 1/1974 | Dawidowicz et al. | 30/50 |
| 3,786,563 | 1/1974 | Dorion, Jr. et al. . | |
| 3,890,704 | 6/1975 | Ferraro . | |
| 3,972,114 | 8/1976 | Chao et al. . | |
| 4,047,296 | 9/1977 | Ishida et al. . | |
| 4,226,019 | 10/1980 | Sugiyama . | |
| 4,247,982 | 2/1981 | Booth et al. . | |
| 4,413,411 | 11/1983 | Trotta . | |
| 4,422,237 | 12/1983 | Trotta . | |
| 4,446,619 | 5/1984 | Jacobson . | |
| 4,640,012 | 2/1987 | Thomas . | |
| 4,641,429 | 2/1987 | Abetemarco . | |
| 4,693,003 | 9/1987 | Ferraro . | |
| 4,852,254 | 8/1989 | Duncan . | |
| 4,944,090 | 7/1990 | Summall . | |
| 5,060,377 | 10/1991 | Althaus et al. | 30/50 |
| 5,113,585 | 5/1992 | Rogers et al. . | |

FOREIGN PATENT DOCUMENTS

| | | |
|---|---|---|
| 569743 | 10/1943 | United Kingdom . |
| WO89/06587 | 7/1989 | WIPO . |

*Primary Examiner*—Douglas D. Watts
*Attorney, Agent, or Firm*—Fish & Richardson

[57] ABSTRACT

A shaving system includes a platform member with a support surface that has a plurality of apertures therein and guard structure integral therewith and disposed forwardly of the support surface, a cap member with a plurality of post elements for disposition in the apertures in the support structure, a primary blade member having a planar body and a cutting edge, a secondary blade member having a planar body and a cutting edge, each blade member having a plurality of apertures and at least two of the apertures having spaced locating surfaces for positioning engagement with the post elements, and a plurality of discrete spacer members disposed on the post elements and between the primary and secondary blade members. The post elements extend through the apertures in the blade members, the spacers and the platform member and preferably are mechanically deformed to secure the primary and secondary blade members with their cutting edges in spaced parallel relation in a fixed shaving geometry. The spacer members maintain predetermined vertical spacing between the cutting edges of the primary and secondary blade members and the post elements maintain predetermined lateral spacing of the blade edges of the primary and secondary blade members relative to the guard structure.

18 Claims, 7 Drawing Sheets

SHAVING SYSTEM

This is a continuation of application Ser. No. 08/142,164, filed Oct. 22, 1993, now abandoned, which is a divisional of application Ser. No. 07/958,500, filed Oct. 8, 1992, now U.S. Pat. No. 5,331,740.

This invention relates to shaving systems and more particularly to safety razors of the wet shave type.

Known shaving systems include two or more blade elements disposed parallel to each other in spaced relation so that the cutting edges are successively active with respect to hair elements being cut during a shaving stroke. Various types of debris such as whisker particles are gradually deposited and tend to clog region between successive cutting edges and adversely affect the shaving characteristics of the shaving system. A number of arrangements have been proposed for removing such debris including a variety of pusher arrangements.

Also, in shaving systems, it is frequently desirable to fix the shaving head relative to the handle portion so that the entire razor structure may be discarded at the end of its useful life. The coupling mechanism between the handle and the shaving head desirably enables and is consistent with economical manufacture of razor components by molding techniques and provides a mechanically sturdy interconnection between the handle and the shaving head.

In accordance with one aspect of the invention, there is provided a shaving system that includes a platform member with a support surface and guard structure and disposed forwardly of the support surface, a cap member, one member having a plurality of post elements for disposition in apertures in the other member, a primary blade member having a planar body and a cutting edge, a secondary blade member having a planar body and a cutting edge, each blade member having a plurality of apertures and at least two of the apertures having spaced locating surfaces for positioning engagement with the post elements, and a plurality of discrete spacer members disposed on the post elements and between the primary and secondary blade members. The post elements extend through the apertures in the blade members, the spacers and the other member and preferably are mechanically deformed to secure the primary and secondary blade members with their cutting edges in spaced parallel relation in a fixed shaving geometry. The spacer members space the blade members and maintain predetermined vertical spacing between the cutting edges of the primary and secondary blade members and the post elements maintain predetermined lateral spacing of the blade edges of the primary and secondary blade members relative to the guard structure.

Preferably, the spacer members provide a plurality of spaced rinse paths that extend in a direction generally perpendicular to the cutting edges and generally parallel to the planes of the blade members, each rinse path in a particular embodiment being about 0.5 millimeter deep and at least about four millimeters wide. The post elements preferably depend from the cap member and engage locating surfaces of apertures in the blade members for positioning the cutting edges of the blade members in the desired shaving geometry; the primary blade in a particular embodiment having a blade tangent angle of about 24°, a span of about 1.5 millimeters and an exposure of about 0.02 millimeter. In preferred embodiments, shaving aid material is secured to the cap member.

In accordance with another aspect of the invention, there is provided a shaving system with a handle member and shaving head assembly that includes at least one blade member with a cutting edge disposed adjacent guard structure. The shaving head assembly includes a socket portion with opposed spaced surfaces, latch structure formed in one of the surfaces and locking edge structure formed in the other of the surfaces opposed to the latch structure. The handle portion includes a grip portion and a projecting prong portion for insertion into the socket portion of the shaving head assembly. The prong portion includes a body portion and a tip portion with a latch projection protruding from one side of the tip portion and a latch recess in the opposite side of the tip portion for engagement with the latch projection and the locking edge structure respectively such that mating surfaces of the socket portion and prong portion are fixed in firm engagement.

Preferably, the prong portion includes a seat surface which cooperates with a seat surface on an interior surface of the socket portion, and supplemental axially extending guide surfaces are provided on the socket and prong portions. In a particular embodiment, a cam surface is provided in the socket portion adjacent the locking edge structure for camming the latch projection over the latch structure of the socket portion, and the socket portion includes a skirt portion which extends below beyond the seat surface and is disposed at an inclined angle to the axis of the socket portion (about 150°). A transition portion between the shaving head assembly and the handle portion has an axis disposed at an angle of about 150° to the plane of the blade members such that the guard structure is disposed about one half centimeter forward of transition portion axis and about one centimeter forward of the grip portion axis.

Other features and advantages of the invention will be seen as the following description of a particular embodiment progresses, in conjunction with the drawings, in which.

DESCRIPTION OF PARTICULAR EMBODIMENT

Figure 1:
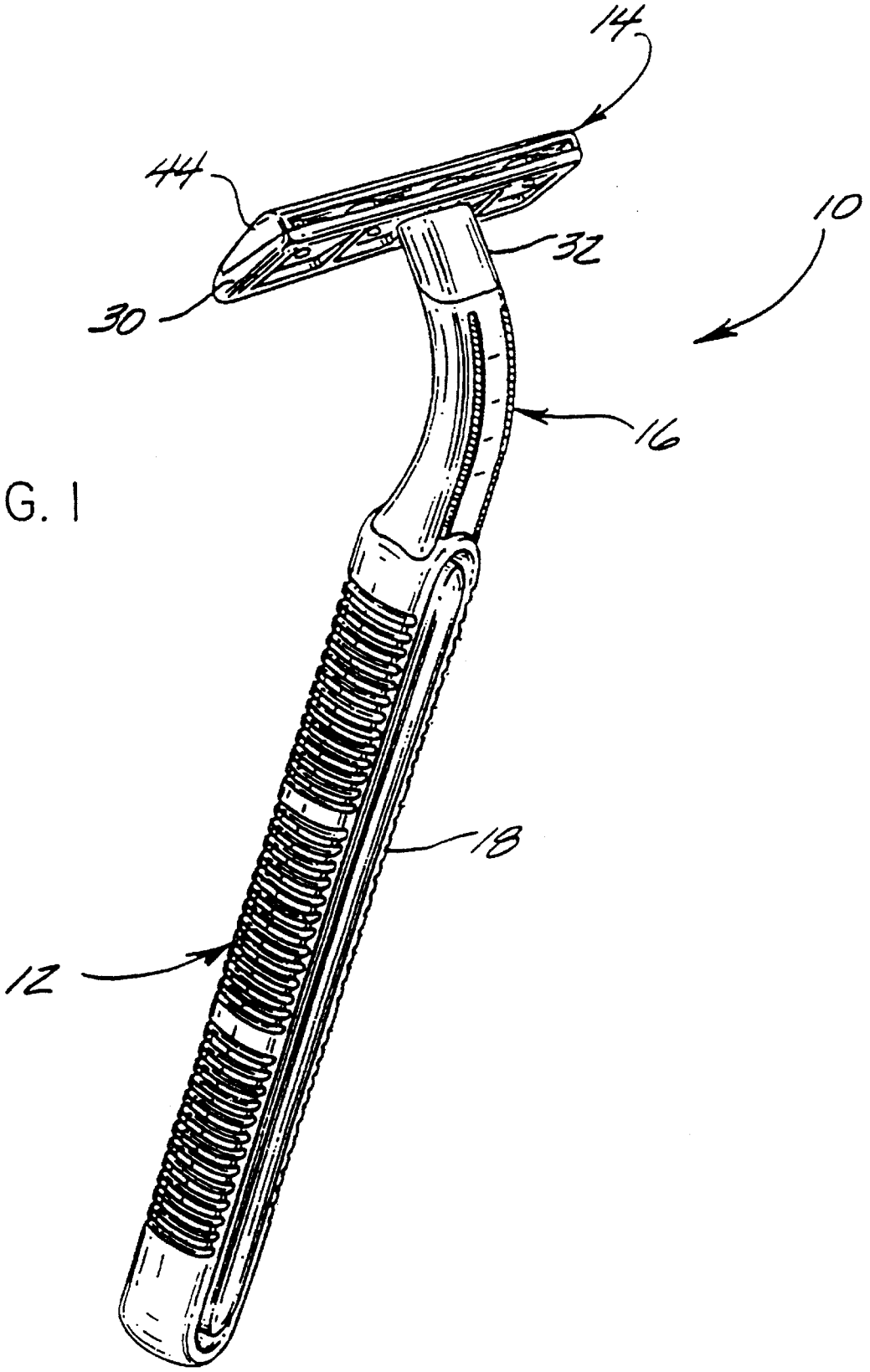
FIG. 1 is a perspective view of a razor assembly in accordance with the invention.
Figure 2:
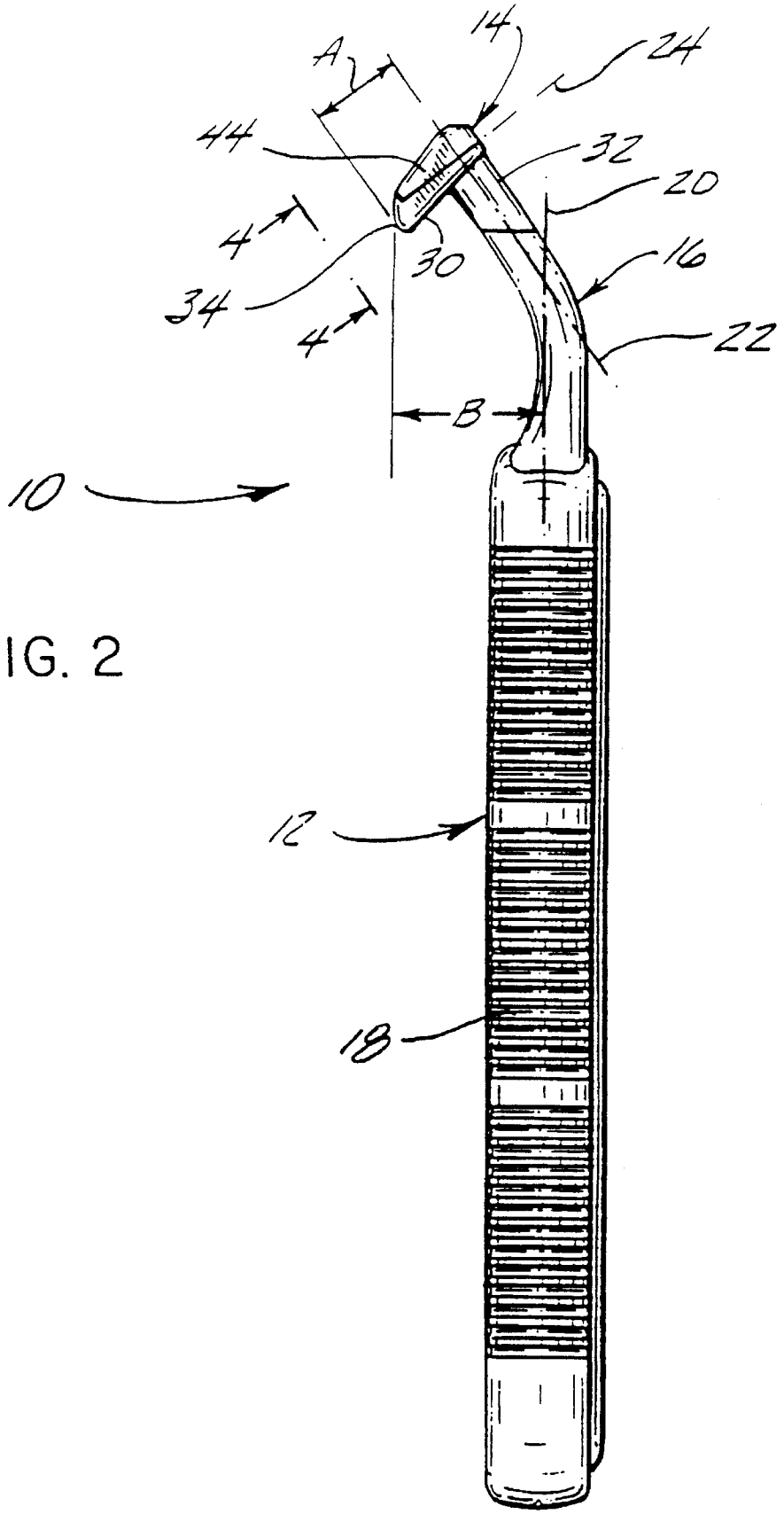
FIG. 2 is a side view of the razor assembly shown in FIG. 1.

The razor assembly 10 shown in FIGS. 1 and 2 includes handle component 12 and shaving head component 14 connected by curved transition portion 16. Handle component 12 is molded of high impact polystyrene and has grip portion 18 that is about eight centimeters long and about one centimeter wide and one centimeter deep and has axis 20. Transition portion 16 provides axis 22 perpendicular to blade plane 24 of shaving head 14 at an angle of 155° to axis 20 and has a length of about one centimeter along axis 20 and a length of about 1.5 centimeters along axis 22 from axis 20 to the base of shaving head 14. Shaving head 14 includes platform member 30 molded of high impact polystyrene and cap member 44 also molded of high impact polystyrene. Guard surface 34 is disposed about six millimeters forward of transition axis 22 (dimension A) and about one centimeter forward of grip axis 20 (dimension B).

Figure 3:
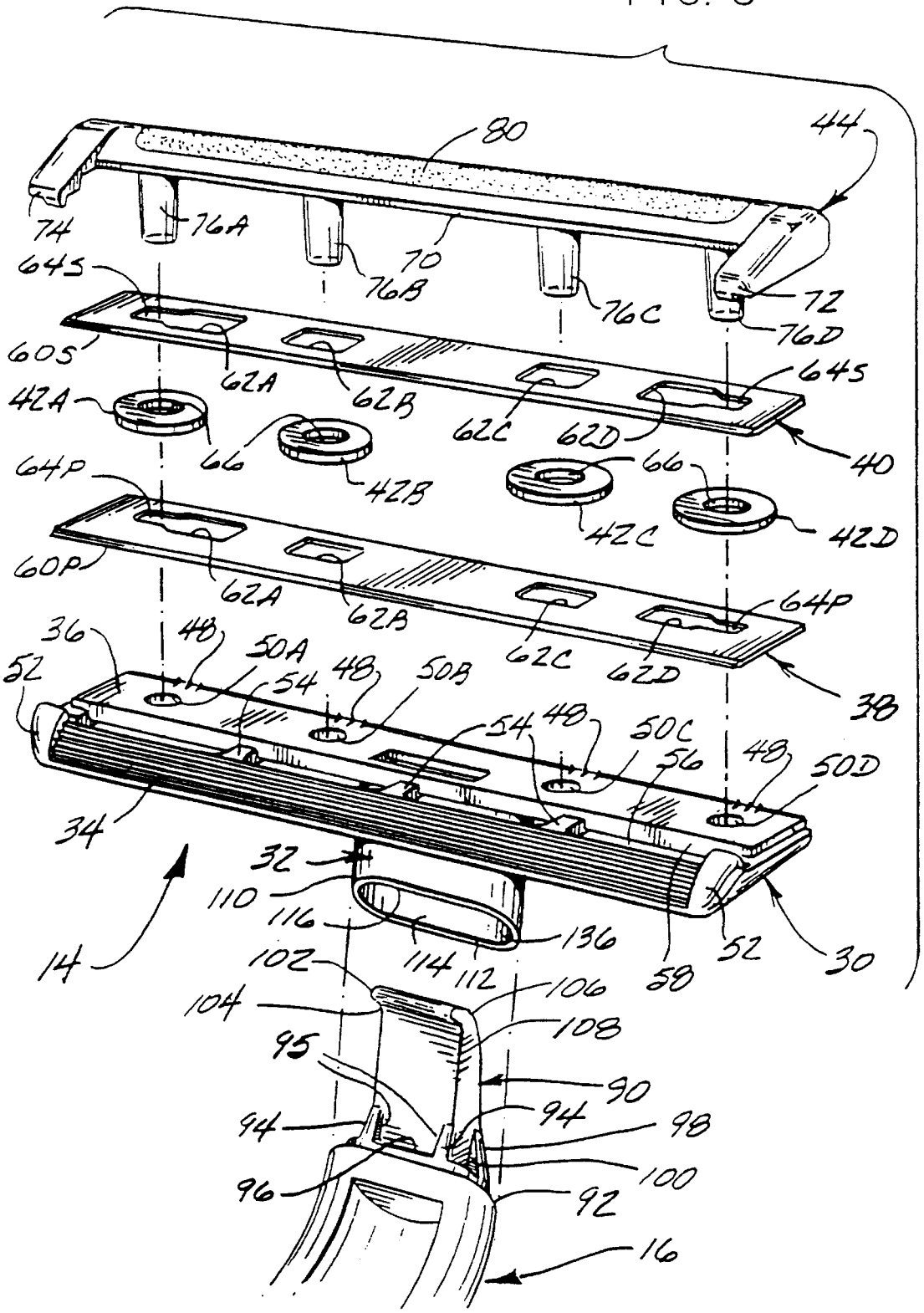
FIG. 3 is an exploded perspective view of components of the shaving head employed in the razor assembly of FIG. 1.

Further details of the shaving head 14 and transition portion 16 may be,seen with reference to the exploded view of FIG. 3. The shaving head 14 includes base or platform member 30 that includes integral socket structure 32, transversely extending guard structure 34, and planar portion 36 on which are disposed steel primary blade element 38 and steel secondary blade element 40 which are maintained in spaced relation by discrete aluminum spacer disks 42A–D. In this embodiment, the blade elements and spacer elements are secured to platform member 30 by cap member 44, and the blade elements 38, 40 are disposed parallel to one another and parallel to plane 24 of FIG. 2.

Formed in planar support surface 36 are a series of crush bumps 48 and four securing apertures 50A–D that are spaced about one centimeter apart. Forwardly extending end wall portions 52 and support webs 54 define drain slots 56 between the forward edge surface 58 of platform portion 30 and guard portion 34.

Each blade element 3B, 40 has parallel front and rear edges, the front edge of each blade element being sharpened to define a cutting edge 60. Each blade has a length of about four centimeters with primary blade 38 having a width of about seven millimeters and secondary blade 40 having a width of about 5.5 milliliters. Formed in each blade are a series of four rectangular apertures 62A–D. Each rectangular intermediate aperture 62B and 62C of has each have a length of about 3.5 millimeters and a width of about 2.75 millimeters while outer apertures 62A and 62D each have a base portion of configuration similar to intermediate apertures 62B and 62C and a locating extension portion 64 that has a width of about two millimeters and a length of about two millimeters. The center lines of locating portions 64P of primary blade 38 are spaced 4.8 millimeters from cutting edge 60P and the center lines of locating portions 64S of secondary blade 40 are spaced 3.3 millimeters from cutting edge 60S. Disposed between blades 38 and 40 are aluminum spacer disks 42A–D, each of which has a thickness of about 0.5 millimeter, an outer diameter of about five millimeters, and an aperture 66 of about 2.1 millimeters diameter.

Cap member 44 includes transversely extending portion 70 disposed between forwardly extending end portions 72, 74. Posts 76A–D (each of about two millimeters diameter and about four millimeters length) extend downwardly from transversely extending portion 70 and are alignable with holes 50, 62, 64 and 66 in the platform, blades and spacer members, respectively. Posts 76 are hollow at their free ends to facilitate cold heading. The top surface of portion 70 includes molded insert 80 of shaving aid material that includes polyethylene oxide.

Figure 4:
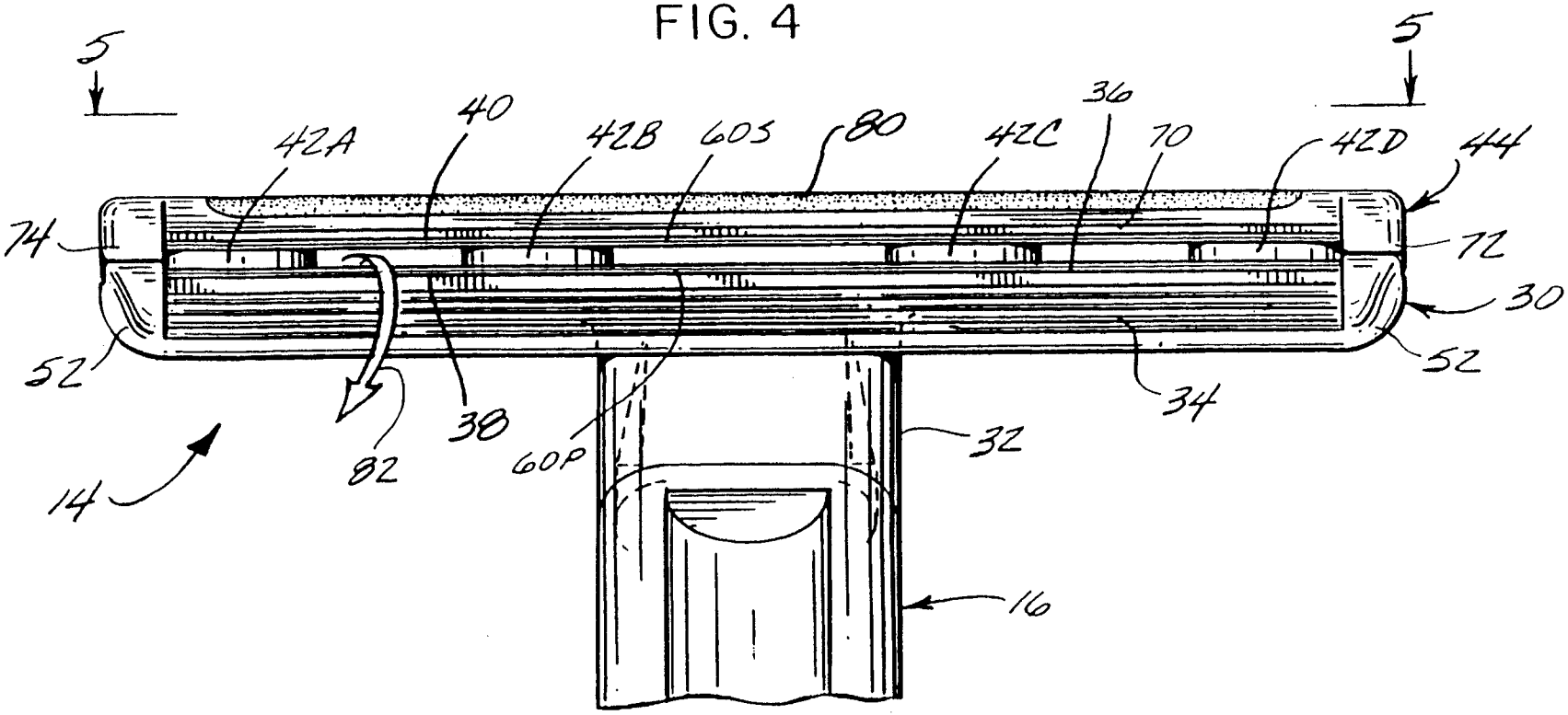
FIG. 4 is a front view of the shaving head of the razor assembly of FIG. 1 in the direction indicated by the line 4—4 of FIG. 2.
Figure 5:
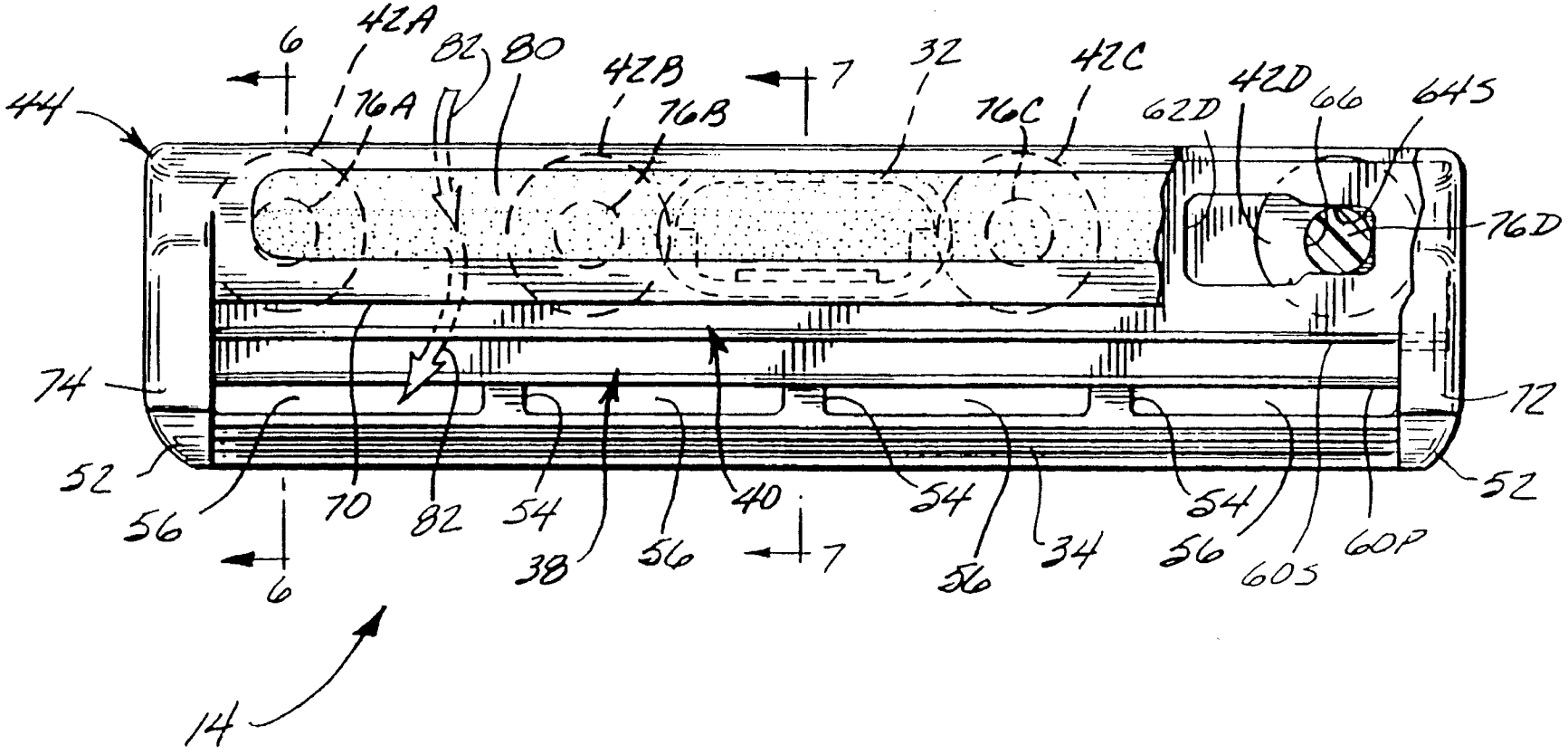
FIG. 5 is a top view of the shaving head of FIG. 4 with a portion broken away.
Figure 6:
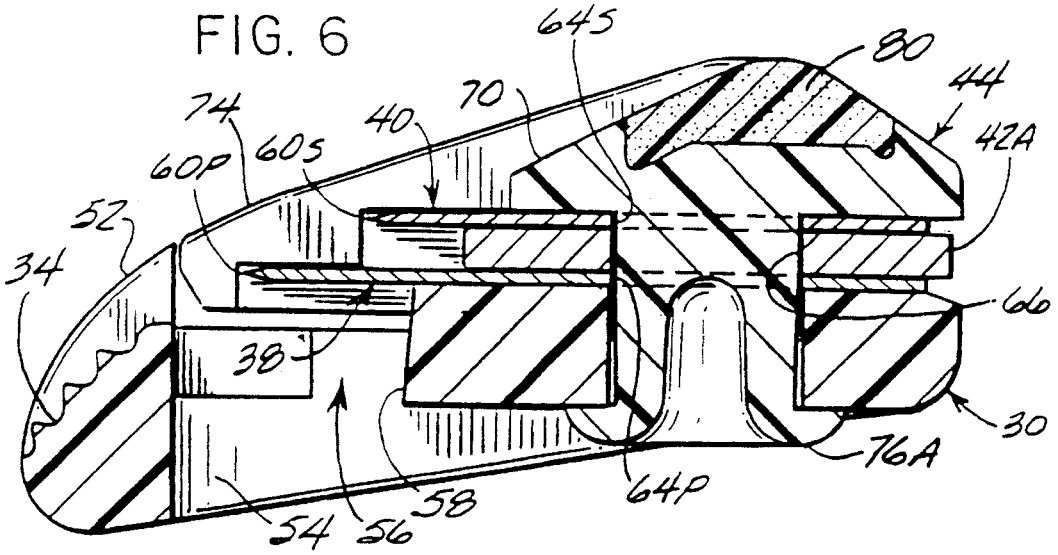
FIG. 6 is a sectional view taken along the line 6—6 of FIG. 5.

In the assembled shaving head 14, as may be seen with reference to the front, top and sectional views of FIGS. 4–6, the cutting edge 60P of primary blade 38 extends over the recesses 56 between forward wall 58 of platform 30 and the rear surface of guard 34 while the cutting edge 60S of secondary blade 40 is spaced about 0.5 millimeter above and 1.5 millimeters rearwardly of edge 60P of primary blade 38 as positioned by posts 76A and 76D in positioning engagement with locating surfaces 64 of blades 38 and 40, platform apertures 50, and spacers 42A–D. Posts 76 fix the shaving edges 60P and 60S of blade members 38 and 40 in position relative to guard 34 and cap 44 with spacers 42 providing stable support and vertical spacing of the shaving edges 60.

Figures 7, 9:
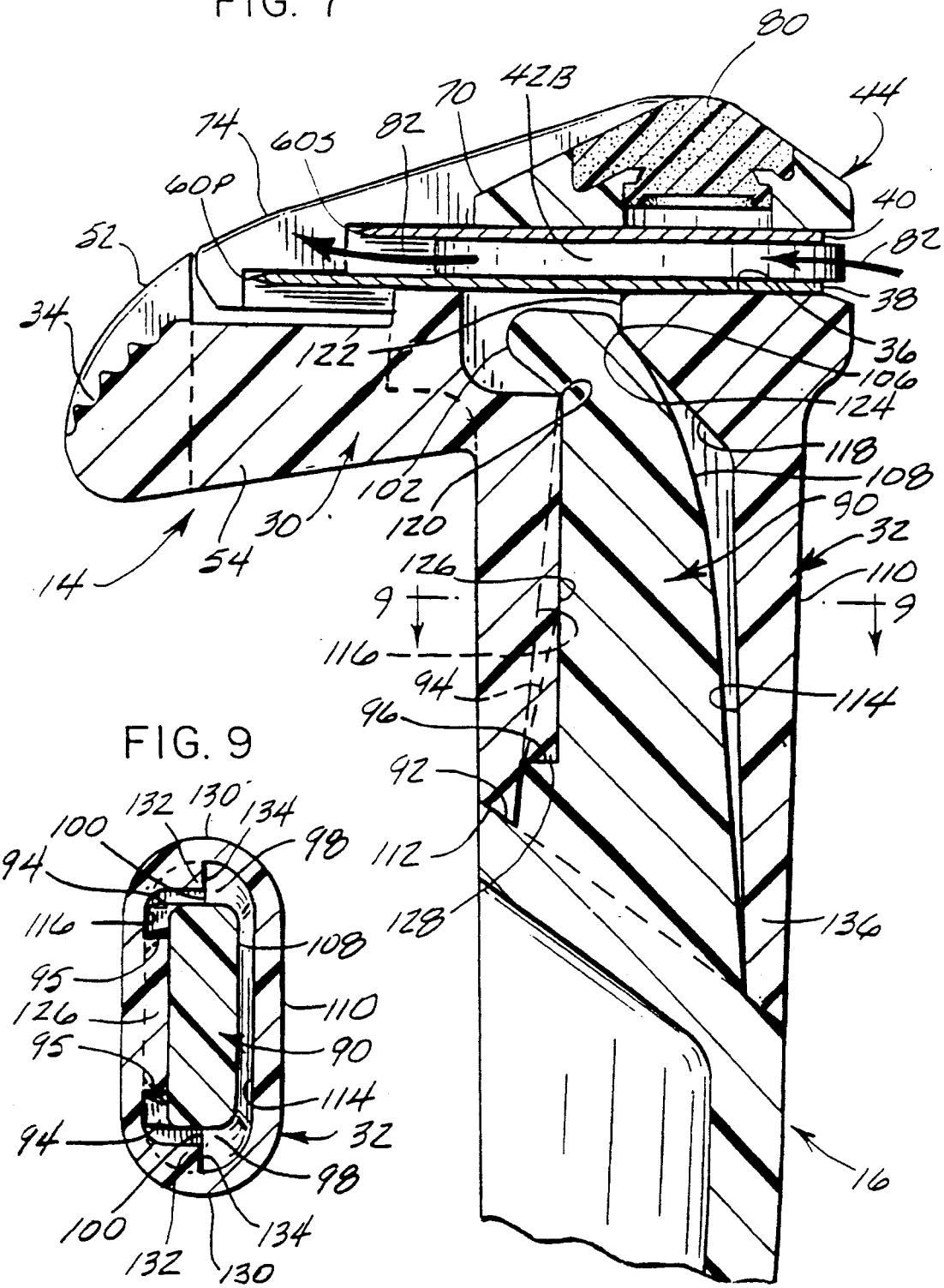
FIG. 7 is a sectional view taken along the line 7—7 of FIG. 5.
FIG. 9 is a sectional view taken along the line 9—9 of FIG. 7.

Rinsing of shaving debris from between the spaced blades is facilitated along flow paths between spacers 42 as indicated by arrows 82 in FIGS. 4, 5 and 7. The resulting blade geometry, as indicated in FIGS. 6 and 7, provides a primary blade tangent angle of about 24.5°, a secondary blade tangent angle of about 22°, exposure for each blade of about 0.02 millimeter, a primary blade span of about 1.3 millimeters and a secondary blade span of about 1.6 millimeters.

Aspects of the coupling in transition portion 16 between handle 12 and shaving head 14 may be seen with reference to FIGS. 3 and 7–9. That coupling includes socket portion 32 of platform member 30 and coupling prong 90 of handle 12. Coupling prong 90 extends from inclined surface 92 and includes spaced guide webs 94 (FIG. 3) that have parallel guide surfaces 95 and define a recess with seat surface 96 that is about four millimeters long and about one-half millimeter deep and supplemental guide webs 98 at each side of prong 90 that have guide surfaces 100 that are about two millimeters long and extend parallel to surfaces 95. Prong 90 has a length of about seven milliliters from the center of inclined surface 92 and a width of about 5.5 millimeters. Latch projection 102 at the end remote from surface 92 has a radius of about one third millimeter and extends forwardly about 0.7 millimeter from a point on prong surface 104 4.75 millimeters from seat surface 96. Latch recess 106 is formed in the rear surface 108 of prong 90.

Figure 8:
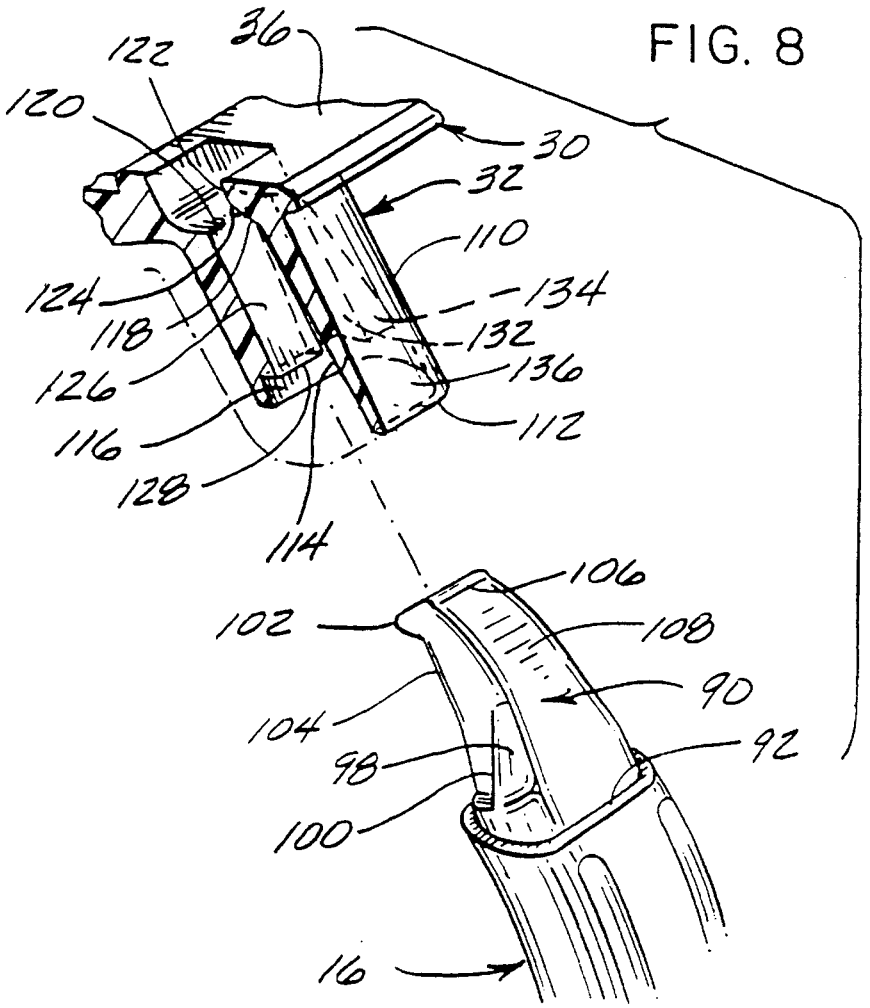
FIG. 8 is an exploded perspective view of portions of the shaving head and handle components of the razor assembly shown in FIG. 1 (with a portion of the socket broken away)

Socket 32 includes depending sleeve portion 110 of oval configuration as indicated in FIGS. 3, 8 and 9 and has rear interior surface 114 and front interior surface 116. Oval end surface 112 has a depth of about three millimeters and a width of about eight millimeters. Rear surface 116 tapers at an angle of two degrees and front surface 114 tapers at an angle of about five degrees to the axis of socket 32. Cam surface 118 (FIG. 7) is disposed at an angle of about 45° to surface 114 at the upper end of that surface. Formed at the upper end of front surface 116 is latch shoulder 120 that is spaced about 1.5 millimeters from cam surface 118. Vertical wall 122 extends upwardly from cam surface 118 and defines a latch edge projection 124 for engagement with prong latch recess 106. Formed on socket front wall 116 is protruding ridge 126 with lower reference surface 128 that is about 4.75 millimeters ,from latch shoulder 120 and that seats on prong recess surface 96. Formed on interior socket side walls 130 are projections 132 with guide surfaces 134 that engage prong guide surfaces 100 as indicated in FIG. 9. Skirt portion 136 extends from surface 128 to end surface 112.

In assembly, prong 90 is inserted into sleeve 110 with its leading end surface being cammed along cam surface 118 as ridge 126, side guide surfaces 100 and 134 engage and is guided by surfaces 95 until socket ridge reference surface 128 is seated on prong recess surface 96. Concurrently latch projection 102 slides over latch shoulder 120 and recess 106 and latch edge 124 are placed in locking engagement to firmly secure shaving head 14 to handle 12 with mating surfaces 96 and 128 in firm engagement as maintained by the resilient interaction by latch projection 102 and latch shoulder 120.

The resulting sturdy razor assembly provides excellent shaving results.

While a particular embodiment of the invention has been shown and described, modifications thereof will be apparent to those skilled in the art, and therefore, it is not intended that the invention be limited to the disclosed embodiment, or to details thereof, and departures may be made therefrom within the spirit and scope of the invention.

What is claimed is:

1. A shaving system comprising a platform member having an elongated support surface and guard structure integral therewith and disposed forwardly of said support surface, a cap member having an integral clamp surface corresponding in length to the length of said support surface, one of said platform and cap members having a plurality of apertures therein and the other of said platform and cap members having a plurality of post elements for disposition in said apertures in said one member, a primary blade member having a planar body seated on said support surface and a cutting edge, a secondary blade member having a planar body in intimate contact along its entire length with said clamp surface of said cap member and a cutting edge, each said blade member having a plurality of apertures and at least two of said apertures having spaced locating surfaces for positioning engagement with said post elements, and a plurality of individual spacer members disposed on said post elements and between said primary and secondary blade members for spacing said blade members, said spacer members being entirely separate from one another, said individual spacer members maintaining predetermined vertical spacing between the cutting edges of said primary and secondary blade members and said post elements maintaining predetermined lateral spacing of the blade edges of said primary and secondary blade members relative to said guard structure, said post elements extending through said apertures in said one member and securing said primary and secondary blade members with said primary blade member seated on said support surface in intimate contact therewith, said secondary blade member in intimate contact along its entire length with said clamp surface, and the cutting edges of said primary and second blade members in spaced parallel relation in a fixed shaving geometry.

2. The system of claim 1 wherein said individual spacer members provide a plurality of spaced rinse paths extending between said blade members in a direction generally perpendicular to said cutting edges and parallel to the bodies of said blade members.

3. The system of claim 2 wherein each said rinse path is about 0.5 millimeter deep and at least about four millimeters wide.

4. The system of claim 1 wherein said cutting edges of said blade members are positioned relative to one another and to said guard structure and said cap member by engagement of said post elements with locating surfaces of said apertures in said blade members.

5. The system of claim 1 wherein said primary blade has a blade tangent angle of about 24°, a span of about 1.5 millimeters and an exposure of about 0.02 millimeter.

6. The shaving system of claim 1 and further including shaving aid material secured to said cap member.

7. The system of claim 1 wherein said cutting edges of said blade members are positioned relative to one another and to said guard structure and said cap member by engagement of said post elements with locating surfaces of said apertures in said blade members, and said primary blade has a blade tangent angle of about 24°, a span of about 1.5 millimeters and an exposure of about 0.02 millimeter.

8. The system of claim 7 wherein said post elements depend from said cap member.

9. The system of claim 8 wherein said individual spacer members provide a plurality of spaced rinse paths extending between said blade members in a direction generally perpendicular to said cutting edges and parallel to the bodies of said blade members, and each said rinse path is about 0.5 millimeter deep and at least about four millimeters wide.

10. The system of claim 1 wherein each said individual spacer member is a disk.

11. The system of claim 10 wherein each said spacer disk has planar top and bottom surfaces, a thickness of about 0.5 millimeter, an outer diameter of about five millimeters, and an aperture of about two millimeters diameter.

12. The system of claim 1 wherein said platform members support surface is planar, said cap member has a planar clamp surface, and said primary and secondary blade members are secured between said planar platform member support surface and said planar cap member clamp surface.

13. The system of claim 12 wherein said individual spacer members provide a plurality of spaced rinse paths extending between said blade members in a direction generally perpendicular to said cutting edges and parallel to the bodies of said blade members.

14. The system of claim 13 wherein each said rinse path is about 0.5 millimeter deep and at least about four millimeters wide.

15. The system of claim 13 wherein each said individual spacer member is a disk.

16. The system of claim 15 wherein said cutting edges of said blade members are positioned relative to one another and to said guard structure and said cap member by engagement of said post elements with locating surfaces of said apertures in said blade members, and said primary blade has a blade tangent angle of about 24°, a span of about 1.5 millimeters and an exposure of about 0.02 millimeter.

17. The system of claim 16 wherein said post elements depend from said cap member.

18. The system of claim 17 wherein each said spacer disk has planar top and bottom surfaces, a thickness of about 0.5 millimeter, an outer diameter of about five millimeters, and an aperture of about two millimeters diameter.

* * * * *